United States Patent [19]

Hattori et al.

[11] 4,431,378

[45] Feb. 14, 1984

[54] SWASH PLATE TYPE COMPRESSOR

[75] Inventors: Mitsuhiro Hattori; Kenji Takenaka; Hayato Ikeda, all of Kariya, Japan

[73] Assignee: Kabushiki Kaisha Toyoda Jidoshokki Seisakusho, Kariya, Japan

[21] Appl. No.: 381,503

[22] Filed: May 24, 1982

Related U.S. Application Data

[63] Continuation of Ser. No. 118,636, Feb. 4, 1980, abandoned.

[30] Foreign Application Priority Data

Feb. 16, 1979 [JP] Japan ..... 54-17432

[51] Int. Cl.[3] ..... F04B 1/16; F04B 1/18

[52] U.S. Cl. ..... 417/269; 92/71

[58] Field of Search ..... 417/269, 439; 92/71

[56] References Cited

U.S. PATENT DOCUMENTS

| | | | |
|---|---|---|---|
| 3,838,942 | 10/1974 | Porkorny | 417/269 |
| 4,101,250 | 7/1978 | Nakayama | 417/269 |
| 4,226,572 | 10/1980 | Nakayama | 417/269 |

*Primary Examiner*—William L. Freeh

*Attorney, Agent, or Firm*—Cushman, Darby & Cushman

[57] ABSTRACT

A swash plate type compressor for use in air conditioning systems operating with a refrigerant gas in which lubricating oil is previously mixed, comprises a plurality of cylinder bores and pistons, a swash plate chamber wherein a swash plate for reciprocating the pistons within the cylinder bores, is accomodated, a plurality of suction passages communicated with the swash plate chamber, suction chambers and exhaust chambers communicated with the cylinder bores, respectively and at least one sub-suction chamber communicated with the suction chambers through a shaft seal chamber wherein a shaft seal member is accomodated.

At least one suction passage which is communicated with the swash plate chamber in the bottom portion thereof is communicated with the sub-suction chamber and the other suction passages are communicated with the suction chambers.

The refrigerant gas and liquid oil stayed in the bottom portion of the swash plate chamber is flowed into the shaft seal chamber through the suction passage which is communicated with the bottom portion of the swash plate chamber, and subsuction chamber.

The refrigerant gas and liquid oil lubricates and cools the shaft seal member accomodated within the shaft seal chamber and is atomized due to the operation of the shaft seal member.

Then, the atomized refrigerant gas is flowed into each of the cylinder bores through the suction chambers.

Therefore, the refrigerant gas is uniformly compressed within each of the cylinder bores without generating liquid compression.

8 Claims, 3 Drawing Figures

SWASH PLATE TYPE COMPRESSOR

This is a continuation, of application Ser. No. 118,636 filed Feb. 4, 1980 now abandoned.

BACKGROUND OF THE PRESENT INVENTION

The present invention relates to a swash plate type compressor and particularly to a swash plate type compressor for use in air conditioning systems for vehicles.

Conventionally, in the swash plate type compressor of this type, the sliding portions thereof are lubricated by circulating refrigerant gas containing lubricating oil which is introduced from an outer refrigeration cycle into a swash plate chamber.

In the swash plate type compressor of this type, a suction passage is perforated within a space between adjacent cylinder bores which are perforated in a combined cylinder block to communicate the swash plate chamber with suction chambers perforated in housings which are fixed to both ends of the combined cylinder block.

However, as the smaller-sized compressor is required, and as the number of the cylinder bores is increased, it has become difficult to obtain a space large enough for perforating the suction passage having a sufficiently large cross-sectional area.

In order to solve the above problem, in each of all spaces between adjacent cylinder bores, a suction passage is perforated.

However, in the compressor having a plurality of suction passages, the liquid refrigerant and liquid oil separated from the refrigerant gas stays in the bottom portion of the swash plate chamber and is supplied from the suction passage positioned in the bottom portion thereof into the suction chamber, and then the liquid refrigerant and liquid oil is sucked into the cylinder bores. Therefore, when the piston 11 is reciprocated, liquid compression occurs within each of the cylinder bores. As a result, in the conventional compressor, parts of the compressor and the pipes positioned outside the compressor communicated thereto are in danger of damage.

And conventionally, when a large number of the cylinder bores is provided in order to make the compressor small and light, an exhaust chamber is disposed near the radially central portion of the housing and the suction chamber is disposed along the outer periphery thereof.

However, in the compressor having the above described construction, the shaft seal chamber through which the drive shaft is inserted is separated from the suction chamber so that the shaft seal member accomodated within the shaft seal chamber is not sufficiently lubricated nor cooled.

As a result, the shaft seal member is damaged after a short period of time.

Accordingly, one object of the present invention is to provide a small sized and light swash plate type compressor, particularly a swash plate type compressor for use in air conditioning systems of a vehicle.

Another object of the present invention is to provide a swash plate type compressor having excellent durability which prevents the liquid compression from occurring in the cylinder bores and which effectively lubricates the sliding portions.

DESCRIPTION OF THE DRAWINGS

Other objects and advantages of the invention will become apparent from the following description of embodiments with reference to the accompanying drawings wherein.

DETAILED DESCRIPTION

Hereinafter, the present invention will be explained in accordance with an embodiment of the present invention with reference to the drawings.

Figure 1:
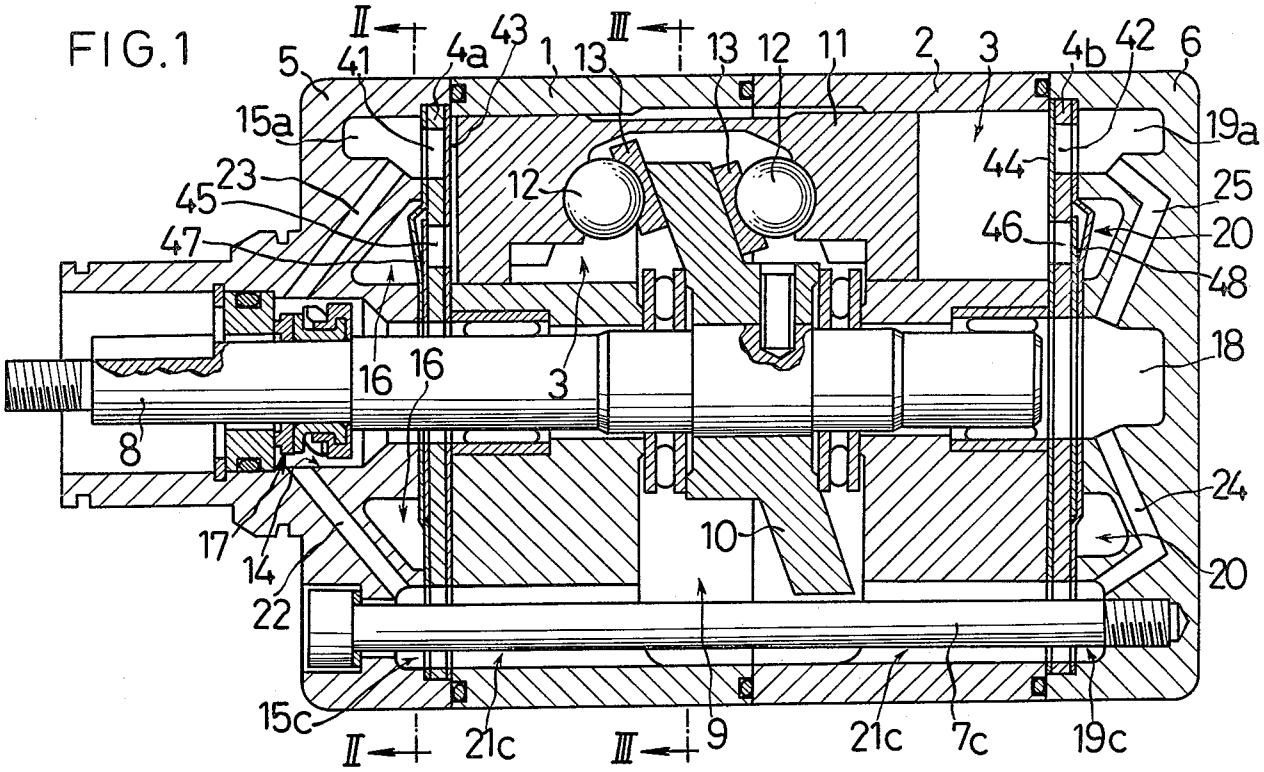
FIG. 1 is a longitudinal sectional view of a swash plate type compressor of an embodiment of the present invention.

In FIG. 1, within cylinder blocks 1 and 2 which are opposed to and connected with each other, five cylinder bores 3 are perforated in the axial direction thereof, respectively. And each of the five cylinder bores perforated within the cylinder block 1 are opposed to and communicated with each of the five cylinder bores perforated within the cylinder block 2.

In end surfaces of the cylinder blocks 1 and 2, a front housing 5 and a rear housing 6 are provided through valve plates 4*a* and 4*b*, respectively.

The cylinder blocks 1 and 2, the front housing 5 and the rear housing 6 are integrally connected by through bolts 7*a*, 7*b*, 7*c*, 7*d* and 7*e*.

In the connecting portion of the cylinder blocks 1 and 2, a swash plate chamber 9 which is communicated with each of the cylinder bores 3 is provided. In the radially central portion of a combined block composed of the cylinder blocks 1 and 2, a drive shaft 8 is inserted therethrough. And the drive shaft 8 is rotatably supported by the combined block.

In the axially central portion of the drive shaft 8, a swash plate 10 is fixed. And the swash plate 10 is accomodated within the swash plate chamber 9.

Within each of the cylinder bores 3, a piston 11 is slidably inserted. Each piston 11 is connected with the swash plate 10 through a bearing ball 12 and a shoe 13.

In the radially central portion of the front housing 5, a shaft seal chamber 14 is provided. And a shaft seal member 17 which is disposed around the drive shaft is accommodated within the shaft seal chamber 14.

In the radially central portion of the rear housing 6, a cavity 18 is provided so as to be opposed to the drive shaft 8.

Within the front housing 5, arc shaped suction chambers 15*a* and 15*b* are perforated or formed along the periphery thereof. The suction chambers 15*a* and 15*b* are communicated with one end of each of the cylinder bores 3 through a suction port 41 provided in the valve plate 4*a*.

Within the rear housing 6, suction chambers 19*a* and 19*b* (not shown) are provided so as to be opposed to the suction chambers 15*a* and 15*b*. The suction chambers 19*a* and 19*b* are communicated with the other end of each of the cylinder bores 3 through a suction port 42 provided in the valve plate 4*b*.

In the suction ports 41 and 42, check valves 43 and 44 are provided so that the fluid is not flowed from the cylinder bores 3 to the suction chambers 15*a*, 15 *b*, 19*a* and 19*b*.

Within the front housing 5, an annular exhaust chamber 16 is perforated or formed in the radially inner side of the suction chambers 15*a* and 15*b*.

The annular exhaust chamber 16 is communicated with one end of each of the cylinder bores 3 through an exhaust port 45 which is provided in the valve plate 4*a*. And within the rear housing 6, an annular exhaust chamber 20 is perforated or formed so as to be opposed to the exhaust chamber 16 of the front housing 5. The annular exhaust chamber 20 is communicated with the other end of each of the cylinder bores 3 through an exhaust port 46 which is provided in the valve plate 4*b*.

In the exhaust ports 45 and 46, check valves 47 and 48 are provided so that the fluid is not flowed in other directions than that from each of the cylinder bores 3 to the exhaust chamber 16 or 20.

Figure 3:
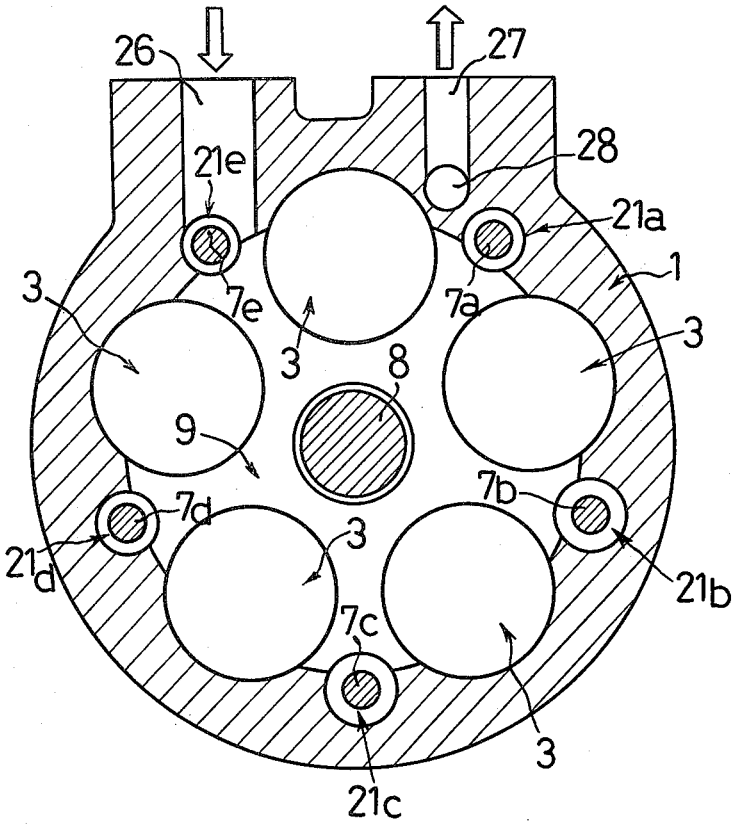
FIG. 3 is a partially cut-away cross sectional view of a swash plate type compressor of the embodiment taken along the line III—III of FIG. 1.

As shown in FIG. 3, in each of the top portions of the cyinder blocks 1 and 2, an inlet port 26 and an outlet port 27 are perforated or formed.

Each of the inlet ports 26 is communicated with the swash plate chamber 9 and opens in the inlet side of the refrigeration cycle.

And each of the outlet ports 27 is communicated with the exhaust chambers 16 and 20 through exhaust passages 28 perforated or formed in the cylinder blocks 1 and 2 and the valve plates 4*a* and 4*b*, and opens in the outlet sie of the refrigeration cycle.

Within the cylinder blocks 1 and 2, bolt holes are perforated between the cylinder bores 3, in the axial direction thereof for inserting through bolts 7*a* to 7*e* therethrough, respectively. And between each of the bolt holes and each of the through bolts, suction passages 21*a*, 21*b*, 21*c*, 21*d* and 21*e* are formed. The cross-sectional area of each of the suction passages is formed so as to be gradually increased in proportion to the increase of the distance from the inlet ports 26. Namely, in FIGS. 2 and 3, the cross-sectional areas of the suction passages 21*b* and 21*c* are the largest of the other suction passages 21*a*, 21*d* and 21*e*. Both ends of the suction passages 21*a* and 21*b* are communicated with the suction chambers 15*b* and 19*b*, respectively and both ends of the suction passages 21*d* and 21*e* are communicated with the suction chambers 15*a* and 19*a*, respectively.

Both end portions of the suction passage 21*c* which is perforated or formed in the bottom portion of the cylinder blocks 1 and 2 around the through bolt 7c are communicated with the sub-suction chambers 15*c* and 19*c* which are perforated in the front housing 5 and the rear housing 6 so as to be separated from the suction chambers 15*a*, 15*b*, 19*a* and 19*b*.

Figure 2:
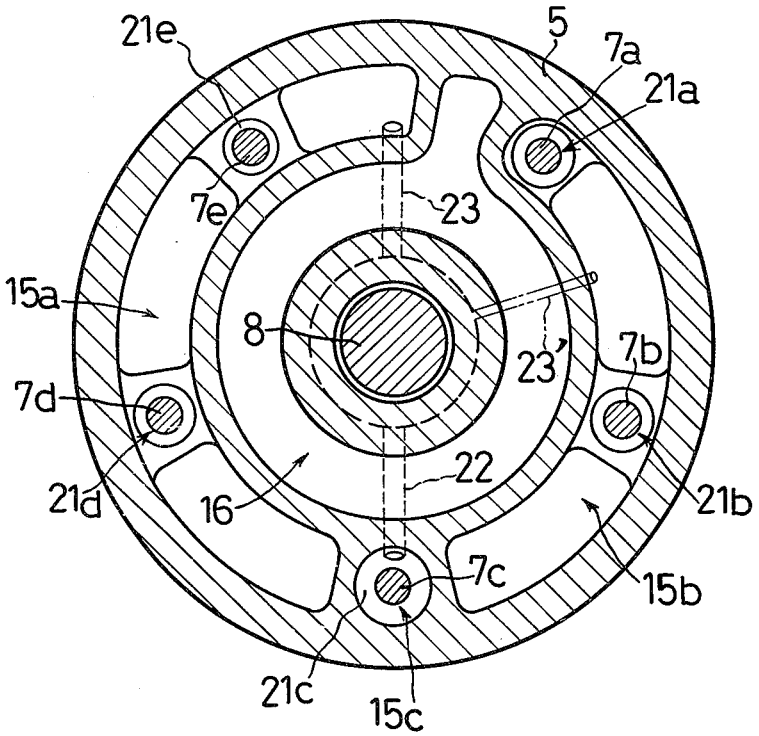
FIG. 2 is a cross sectional view of a swash plate type compressor of the embodiment taken along the line II—II of FIG. 1.

The sub-suction chamber 15*c* is communicated with the shaft seal chamber 14 through a first channel 22 which is perforated or formed within the front housing 5. The shaft seal chamber 14 is also communicated with the upper portions of the suction chambers 15*a* and 15*b* through second channels 23 and 23' which are perforated or formed within the front housing 5, respectively as shown in FIG. 2. And the sub-suction chamber 19*c* is communicated with the cavity 18 through a third channel 24.

The cavity 18 is communicated with the upper portion of the suction chambers 19*a* and 19*b* through fourth channels 25 and 25' (not shown), respectively.

Hereinafter, the operation of the compressor having the above described construction will be explained.

When the drive shaft 8 is rotated, the swash plate 10 which is integrally fixed to the drive shaft 8 is rotated within the swash plate chamber 9. And each of the piston 11 reciprocates within each of the cylinder bores 3. Within the swash plate chamber 9 which is communicated with the inlet side of the cylinder bores 3 through the suction passages 21*a* to 21*e* and the suction chambers 15*a*, 15*b*, 19*a* and 19*b*, suction force occurs. Refrigerant gas is sucked into the swash plate chamber 9 from the inlet side of the refrigeration cycle through the inlet ports 26. And each of sliding portions within the swash plate chamber 9 is lubricated and cooled by oil included in the refrigerant gas.

Then, the refrigerant gas sucked within the swash plate chamber 9 is flowed into the suction passages 21*a* to 21*e*. And the refrigerant gas is flowed from the suction passages 21*a*, 21*b*, 21*d* and 21*e* to the suction chambers 15*a*, 15*b*, 19*a* and 19*b* directly.

And the refrigerant gas which was flowed into the suction passages 21*c* is flowed into the suction chambers 15*a*, 15*b*, 19*a* and 19*b* through the sub-suction chambers 15*c* and 19*c*, the channels 22 and 24, the shaft seal chamber 14, the cavity 18 and the channels 23, 23', 25 and 25'.

Due to the reciprocation of each of the pistons 11, the refrigerant gas is sucked within each of the clinder bores 3 and compressed therewithin. And the compressed refrigerant gas is discharged into the exhaust chambers 16 and 20 and supplied into the outlet side of the refrigeration cycle through the exhaust passages 28 and the outlet ports 27.

The refrigerant gas having high oil content and liquid oil separated from the refrigerant gas stays in the bottom portion of the swash plate chamber 9. The refrigerant gas and liquid oil that stays in the bottom portion of the swash plate chamber 9 is flowed into the suction passage 21*c* and then flowed into the shaft seal chamber 14 and the cavity 18 through the sub-section chambers 15*c* and 19*c*, the first channel 22 and the third channel 24.

The refrigerant gas having high oil content and liquid oil lubricates and cools the shaft seal member 17 within the shaft seal chamber 14. And the refrigerant gas having high oil content and liquid oil also lubricates and cools a bearing portion of the end of the drive shaft 8 within the cavity 18. Then, the refrigerant gas and liquid oil is flowed into the suction chambers 15*a*, 15*b*, 19*a* and 19*b* through the second channels 23 and 23' and the fourth channels 25 and 25'.

The liquid refrigerant and the liquid oil which is flowed into the shaft seal chamber 14 and the cavity 18 is stirred and atomized due to the operation of the shaft seal member 17 and the drive shaft 8. Then, the atomized gas is flowed into each of the cylinder bores 3 through the suction chambers 15*a*, 15*b*, 19*a* and 19*b*. Therefore, liquid compression does not occur within each of the cylinder bores 3.

And the oil content of the refrigerant gas which is flowed into each of the cylinder bores 3 becomes uniform. Therefore, the compression efficiency of each of the cylinder bores 3 becomes uniform.

Since the second channels 23 and 23' and the fourth channels 25 and 25' are communicated with the upper portions of the suction chambers 15*a*, 15*b*, 19*a* and 19*b*, respectively, the refrigerant gas having high oil content and liquid oil separated from the refrigerant gas which stays in the bottom portion of the compressor is supplied into the upper portions of the suction chambers 15*a*, 15*b*, 19*a* and 19*b*, after atomized within the shaft seal chamber 14 and the cavity 18.

Therefore, the sliding portions of the compressor can be lubricated uniformly by the refrigerant gas wherein oil particles are uniformly distributed.

In the swash plate type compressor, the volume of the refrigerant gas flowing within each of the suction passages 21*a* to 21*e* is different from each other. Particularly, the volume of the refrigerant gas flowing within the suction passage distant from the inlet port 26 becomes smaller. Therefore, by making the cross-sectional area of the suction passage positioned distant from the inlet port 26 larger than that of the suction passage positioned near the inlet port 26, the volume of the refrigerant gas which is supplied into each of the cylinder bores 3 can be made uniform and the compression effieiency of the refrigerant gas within each of the cylinder bores 3 can be also made uniform.

In the above described embodiment, the shaft seal member 17 and the end of the drive shaft 8 is lubricated and cooled by the refrigerant gas having high oil content and liquid oil separated from the refrigerant gas, which is supplied through the suction passage 21*c*.

Instead of the above embodiment, in another embodiment wherein only the shaft seal member 17 is lubricated and cooled, the durability of the compressor can be also improved. In this case, since the cavity 18 is omitted, the sub-suction chamber 19*c* is directly communicated with the other suction chambers 19*a* and 19*b*. Therefore, the volume of the refrigerant gas and liquid oil flowing out of the suction passage 21*c* is required to be restrained by throttling the suction passage 21*c* near the rear housing 6.

In the above described embodiment of the present invention, five cylinder bores and five suction passages are provided. Other arbitary number of the cylinder bores and the suction passages can be employed.

When the number of the cylinder bores is large and the sufficiently large space cannot be obtained between the cylinder bores, it is advantageous that the bolt holes also serve as the suction passages.

When the number of the cylinder bores is relatively small and the sufficiently large space can be obtained between the cylinder bores, suction passages can be perforated in different spaces of the cylinder blocks from the bolt holes.

And in the above described embodiment, two channels 23 and 23' are employed in order to communicate with the shaft seal chamber 14 and the suction chambers 15*a* and 15*b*. Only one channel, namely 23 in FIG. 2 also achieves the lubrication and the cooling of the shaft seal member 17.

As described above, in the swash plate type compressor of the present invention, the refrigerant gas having high oil content, liquid oil separated from the refrigerant gas or liquid refrigerant gas is introduced from the bottom portion of the swash plate chamber into the cylinder bores not directly but through members which are required to be lubricated and cooled, such as the shaft seal member.

Therefore, such members as described above can be sufficiently lubricated and cooled.

In addition, since the refrigerant gas which is atomized due to the operation of such members as described above is supplied into each of the cylinder bores, liquid compression can be prevented from occurring within each of the cylinder bores.

As a result, the durability of the swash plate type compressor can be improved and also the operation thereof can be stabilized.

Having now fully described the invention, it will be apparent to one of ordinary skill in the art that many changes and modifications can be made thereto without departing from the spirit or scope of the invention as set forth herein.

What is claimed is:

1. A swash plate type compressor comprising:

a pair of horizontal axially aligned cylinder blocks forming a combined block having at least one inlet port for introducing a refrigerant gas containing lubricating oil from an outer refrigeration cycle into said combined block and at least one outlet port for discharging a compressed gas into said outer refrigeration cycle;

a swash plate chamber formed in the axially central portion of said combined block;

a plurality of cylinder bores formed in said combined block in the axial direction thereof;

a plurality of pistons, one of said plurality of pistons being slidably inserted within a respective one of said plurality of cylinder bores;

a drive shaft disposed through said swash plate chamber and rotatably supported therein;

a swash plate disposed within said swash plate chamber and fixed to said drive shaft so as to be rotated therewith, said swash plate being operatively connected to said pistons so as to reciprocate said pistons within said cylinder bores as said swash plate rotates;

a pair of cylindrical housings respectively fixed to opposite ends of said combined block, one of said pair of cylindrical housings having a shaft seal chamber in the axial portion thereof for accomodating a shaft seal member which is disposed around said drive shaft;

at least one suction chamber and at least one exhaust chamber concentrically formed in each of said pair of cylindrical housings, said suction chamber and said exhaust chamber being communicated with each of said cylinder bores through valve means;

at least one sub-suction chamber formed in said cylindrical housing having said shaft seal chamber so as to be separated from said suction chamber;

a plurality of suction passages formed in said combined block so as to extend axially thereof between and adjacent said cylinder bores, said suction passages being communicated with said swash plate chamber, at least one of said suction passages being positioned in the bottom portion of said combined block and connected to said at least one sub-suction chamber while the other ones of said suction passages are directly connected with said at least one sub-suction chamber; and a plurality of channels formed in said cylindrical housing having said shaft seal chamber, said channels connecting said at least one sub-suction chamber with said at least one suction chamber through said shaft seal chamber.

2. A swash plate type compressor according to claim 1, wherein:

said suction chamber and said exhaust chamber are concentrically disposed with each other; and said suction chamber is disposed in the radially outer side of said exhaust chamber.

3. A swash plate type compressor as in claim 1, wherein said at least one sub-suction chamber is located at the bottom of said housing having said shaft seal chamber.

4. A swash plate type compressor as in claim 1, wherein said at least one suction passage is formed so as to be opposed to said sub-suction chamber.

5. A swash plate type compressor as in claim 1, wherein a sub-suction chamber is formed in each of said cylindrical housings with each being in direct communication with said bottom suction passage, at opposite ends thereof, so that oil is supplied to said shaft seal chamber only from said bottom suction passage.

6. A swash plate type compressor according to claim 1, wherein:

the other cylinder housing comprises:

a cavity formed in the axial portion thereof so as to be opposed to an end of said drive shaft, at least one sub-suction chamber formed in the bottom portion thereof so as to be communicated with said at least one suction passage positioned in the bottom portion of said combined block; and a plurality of channels connecting said sub-suction chamber and said suction chamber through said cavity.

7. A swash plate type compressor according to either claim 1 or 6, wherein:

the cross-sectional area of each of said plurality of suction passages is gradually increased in proportion to the increase of the distance from said inlet port.

8. A swash plate type compressor according to claim 6, wherein:

said combined block and said cylinder housings are connected by means of a plurality of through bolts;

the shank portion of each of said through bolts is inserted through one of said suction passages; and the diameter of said shank portion is smaller than that of said suction passage through which it extends.

* * * * *